US006433470B1

(12) United States Patent
Watanabe et al.

(10) Patent No.: US 6,433,470 B1
(45) Date of Patent: Aug. 13, 2002

(54) COLOR CATHODE RAY TUBE

(75) Inventors: Mitsuru Watanabe, Mutsusawa; Yoshiki Nakano, Mobara, both of (JP)

(73) Assignees: Hitachi, Ltd., Tokyo; Hitachi Device Engineering Co., Mobara, both of (JP)

( * ) Notice: Subject to any disclaimer, the term of this patent is extended or adjusted under 35 U.S.C. 154(b) by 187 days.

(21) Appl. No.: 09/632,110

(22) Filed: Aug. 3, 2000

(30) Foreign Application Priority Data

May 8, 2000 (JP) ..... 2000-134494

(51) Int. Cl.[7] ..... H01J 29/10
(52) U.S. Cl. ..... 313/461; 313/477 R
(58) Field of Search ..... 313/408, 461, 313/463, 473, 477 R

(56) References Cited

FOREIGN PATENT DOCUMENTS

| | | |
|---|---|---|
| JP | 04-212244 | 8/1992 |
| JP | 05-151914 | 6/1993 |
| JP | 05-159722 | 6/1993 |
| JP | 06-302284 | 10/1994 |
| JP | 09-245685 | 9/1997 |
| JP | 11-242940 | 9/1999 |
| JP | 11-260293 | 9/1999 |
| JP | 11-288676 | 10/1999 |
| JP | 2000-067784 | 3/2000 |
| JP | 2000-149809 | 5/2000 |
| JP | 2000-149829 | 5/2000 |

*Primary Examiner*—Vip Patel
(74) *Attorney, Agent, or Firm*—Milbank, Tweed, Hadley & McCloy LLP

(57) ABSTRACT

To provide a flat panel type color cathode ray tube which has a favorable feeling of flatness and can improve the drop strength of a shadow mask, a curvature along a diagonal direction of an outer surface of a panel 1 approximates to flat, an equivalent radius of curvature $R_{ox}$ along an X axis on the outer surface of the panel 1 is made smaller than an equivalent radius of curvature $R_{oy}$ along an Y axis on the outer surface of the panel 1 and an equivalent radius of curvature $R_{ix}$ along the X axis on an inner surface of the panel 1 is made larger than an equivalent radius of curvature $R_{iy}$ along the Y axis on the inner surface of the panel 1. Further, the optimum value of a ratio between the equivalent radius of curvature along the Y axis on the inner surface of the panel 1 and the equivalent radius of curvature along the X axis on the inner surface of the panel 1 is set to fall within the range of $0.7<(R_{iy}/R_{ix})<1.0$.

20 Claims, 5 Drawing Sheets

COLOR CATHODE RAY TUBE

BACKGROUND OF THE INVENTION

The present invention relates to a color cathode ray tube, and more particularly to a so-called flat panel type color cathode ray tube which is provided with a panel whose outer surface has the radius of curvature extremely larger than that of an inner surface thereof.

Recently, color cathode ray tubes called the flat face type or the flat panel type have been widely adopted as picture tubes for television receivers or monitor display tubes of personal computers or the like.

Generally, a glass-made envelope of a color cathode ray tube is composed of a panel which forms a display part (screen), a narrow-diameter neck and a funnel which connects the panel with the neck. A phosphor screen (a phosphor film) coated with a phosphors in three colors is formed on the inner, surface of the panel and a shadow mask which works as a color selection electrode is disposed close to this phosphor screen.

Further, an electron gun which emits three electron beams is accommodated in the inside of the neck and three electron beams emitted from the electron gun are made to pass through beam apertures formed on the shadow mask and are impinged on respective phosphors to reproduce color images.

Recently, this type of color cathode ray tube has an outer surface of the panel thereof flattened so as to enhance the visibility thereof. Particularly, this flattening of the panel is widely adopted with respect to color cathode ray tubes having large screens. The color cathode ray tubes having such flattened panels are called the flat panel type color cathode ray tubes.

As documents which disclose conventional techniques on this kind of flat panel type color cathode ray tube, Japanese Laid-open Patent Publication 9-245685 and Japanese Laid-open Patent Publication 11-238475 can be named.

SUMMARY OF THE INVENTION

FIG. 5 is a schematic cross-sectional view showing a structural example of an essential-part of a flat panel type color cathode ray tube. In the drawing, a panel 1 is joined to a large diameter periphery which constitutes one end of a funnel 3 and the other end of the funnel 3 which gradually narrows its diameter in a funnel shape is connected to a neck not shown in the drawing.

An outer surface PO of the panel 1 which forms a phosphor screen 15 having an approximately rectangular shape on an inner surface thereof has a curved surface which is substantially a flat surface, wherein the radius of curvature of a curved surface of the inner surface PI is set to be smaller than the radius of curvature of the outer surface PO for maintaining the mechanical strength of a glass-made envelope.

A shadow mask 6 is disposed in the vicinity of this phosphor screen 15. A large number of electron beam passing apertures 6*a* are formed in the shadow mask 6. The shadow mask 6 is welded to a mask frame 7 and is held to the inner surface of a side wall of the panel 1 by way of a suspension mechanism not shown in the drawing.

In view of the manufacturing cost and the easiness of manufacturing, with respect to the above-mentioned flat panel type color cathode ray tube, the outer surface (also called "face") of the panel is set to have a large radius of curvature, that is, the outer surface is set to an approximately flat surface, while the inner surface on which a phosphor layer is formed is set to have a relatively small radius of curvature to a degree that the feeling of a flatness of a displayed image is not spoiled when the display screen is seen from the outer surface.

In manufacturing the flat panel type color cathode ray tube, it is easy to approximate the shape of the outer surface of the panel to the flat surface. However, to approximate the inner surface of the panel to the flat surface, the thickness of the whole panel must be considerably increased to increase the mechanical strength of the glass-made envelope. Therefore, this is not practical in view of the increase of the weight of the cathode ray tube, the increase of cost and the like.

Further, on the other hand, with respect to the shadow mask which is not a color selection electrode of a so-called tension type, it is necessary to form a mask surface thereof with a certain degree of curvature while eliminating a completely flat surface to make the shadow mask stand by itself. Since the manufacturing of a shadow mask having large radius of curvature by a press molding is technically limited, it is necessary to give a given curvature to the shadow mask and simultaneously to give a given curvature to the inner surface of the panel.

As shown in FIG. 5, the curvature of the inner surface PI of the panel 1 is larger than the curvature of the outer surface PO (the radius of curvature of PI being smaller than the radius of curvature of PO) and the shadow mask 6 approximately traces the shape of the curved surface (warp) of the inner surface PI of this panel so that the flatness is deteriorated at the end peripheries in the long axis side (X axis) on the screen 15.

In the flat panel type which largely warps the inner surface, there has been a problem that the larger the panel size of the color cathode ray tube (equal to or more than 'nominal 17 inches' (effective screen diagonal diameter being 41 cm)) becomes, the feeling of flatness in the short sides of the screen (end portions in the X axis direction) is worsened due to the aspect ratio of the screen.

Further, in the above-mentioned flat panel type color cathode ray tube, the shape of the curved surface of the shadow mask 6 per se approximately follows the shape of the inner surface PI of the panel 1. Accordingly, although it may be certain that the radius of the curvature of the inner surface PI of the panel 1 is actually set smaller than the radius of curvature of the outer surface PO, of the panel 1, compared to a conventional spherical panel type color cathode ray tube, the flatness of the inner surface PI of the panel 1 and the shadow mask 6 is made extremely greater.

Accordingly, when a display monitor is completed by assembling the color cathode ray tube in the display monitor, there has been a problem that the shadow mask is liable to be easily deformed against an external impact. That is, the flatter the shape of the curved surface of the shadow mask 6 is, the shadow mask is liable to be deformed more and this has been one of factors which impede the enhancement of the quality.

The typical object of the present invention is to provide a color cathode ray tube provided with a panel which enhances the visual characteristics and a shadow mask which exhibits a high resistance against a mechanical impact.

According to the typical aspect of the present invention, focusing on a finding that the visual characteristics of an approximately rectangular effective screen (phosphor screen) formed on a panel of a color cathode ray tube dominantly depends on the radius of curvature in the short side direction, that is, the short axis (Y axis) direction of the panel in view of the aspect ratio, the shape of the curved surface of the panel in the phosphor screen region and the shape of the curved surface of the shadow mask in the apertures region are constituted as follows.

(1) The curvature along the diagonal direction of the outer surface of the panel approximates to flat, the equivalent radius $R_{ox}$ of curvature along the long axis (X axis) of the outer surface of the panel is set smaller than the equivalent radius $R_{oy}$ of curvature along the short axis (Y axis) of the outer surface of the panel and the equivalent radius $R_{ix}$ of curvature along the long axis (X axis) of the inner surface of the panel is set larger than the equivalent radius $R_{iy}$ of curvature along the short axis (Y axis) of the inner surface of the panel.

(2) In accordance with a result of an analysis, a suitable value of a ratio between the equivalent radius of curvature along the Y axis of the inner surface of the panel and the equivalent radius of curvature along the X axis of the inner surface of the panel is set to fall in the range of $0.7<(R_{iy}/R_{ix})<1.0$.

(3) The equivalent radius $R_{ol}$ of curvature along the long side portions of the outer surface of the panel is set smaller than the equivalent radius $R_{os}$ of curvature along the short side portions of the outer surface of the panel and the equivalent radius $R_{il}$ of curvature along the long side portions of the inner surface of the panel is set larger than the equivalent radius $R_{is}$ of curvature along the short side portions of the inner surface of the panel.

(4) In accordance with a result of an analysis, a suitable value of a ratio between the equivalent radius of curvature along the short side portions of the inner surface of the panel and the equivalent radius of curvature along the long side portions of the inner surface of the panel is set to fall in the range of $0.7<(R_{is}/R_{il})<1.0$.

(5) The arrangement pitch in the horizontal direction of the electron beam passing apertures formed in the shadow mask is set to a variable pitch which becomes larger from the central portion to the peripheral portions (end portions) along the X axis.

(6) The equivalent radius $R_{os}$ of curvature along the short side portions of the outer surface of the panel is set equal to or more than 10000 mm.

In the above-mentioned respective constitutions, particularly, by setting the equivalent radius $R_{ox}$ of curvature along the X axis of the outer surface of the panel smaller than the equivalent radius $R_{oy}$ of curvature along the Y axis of the outer surface of the panel or by setting the equivalent radius $R_{ol}$ of curvature along the long side portions of the outer surface of the panel smaller than the equivalent radius $R_{os}$ of curvature along the short side portions of the outer surface of the panel, the visual characteristics, that is, the feeling of flatness of the screen which is one of the tasks of the present invention is greatly enhanced.

Further, by setting the equivalent radius $R_{ix}$ of curvature along the X axis of the inner surface of the panel larger than the equivalent radius $R_{iy}$ of curvature along the Y axis of the inner surface of the panel or by setting the equivalent radius $R_{il}$ of curvature along the long side portions of the inner surface of the panel larger than the equivalent radius $R_{is}$ of curvature along the short side portions of the inner surface of the panel, the impact resistance characteristics, that is, the mechanical strength which is one of the tasks of the present invention is greatly enhanced.

By setting the suitable value of the ratio between the equivalent radius of curvature $R_{iy}$ along the Y axis of the inner surface of the panel and the equivalent radius of curvature $R_{ix}$ along the X axis of the inner surface of the panel such that the value falls in the range of $0.7<(R_{iy}/R_{ix})<1.0$, the mechanical strength of the shadow mask is further reinforced and the impact resistance in the drop test of the completed color cathode ray tube is greatly enhanced.

Due to such constitutions, the flat panel type color cathode ray tube which has the improved visibility and can suppress the deformation of the shadow mask due to the external impact can be obtained.

Although operations and effects of the above-mentioned typical. constitutions will be explained in detail in the paragraphs of embodiment, it is needless to say that the present invention is not limited to those described in the embodiment and various modifications can be considered without departing from the technical ideas of the present invention.

DETAILED DESCRIPTION OF THE PREFERRED EMBODIMENTS

Embodiments of the present invention is hereinafter explained in detail in conjunction with attached drawings.

Figure 1:
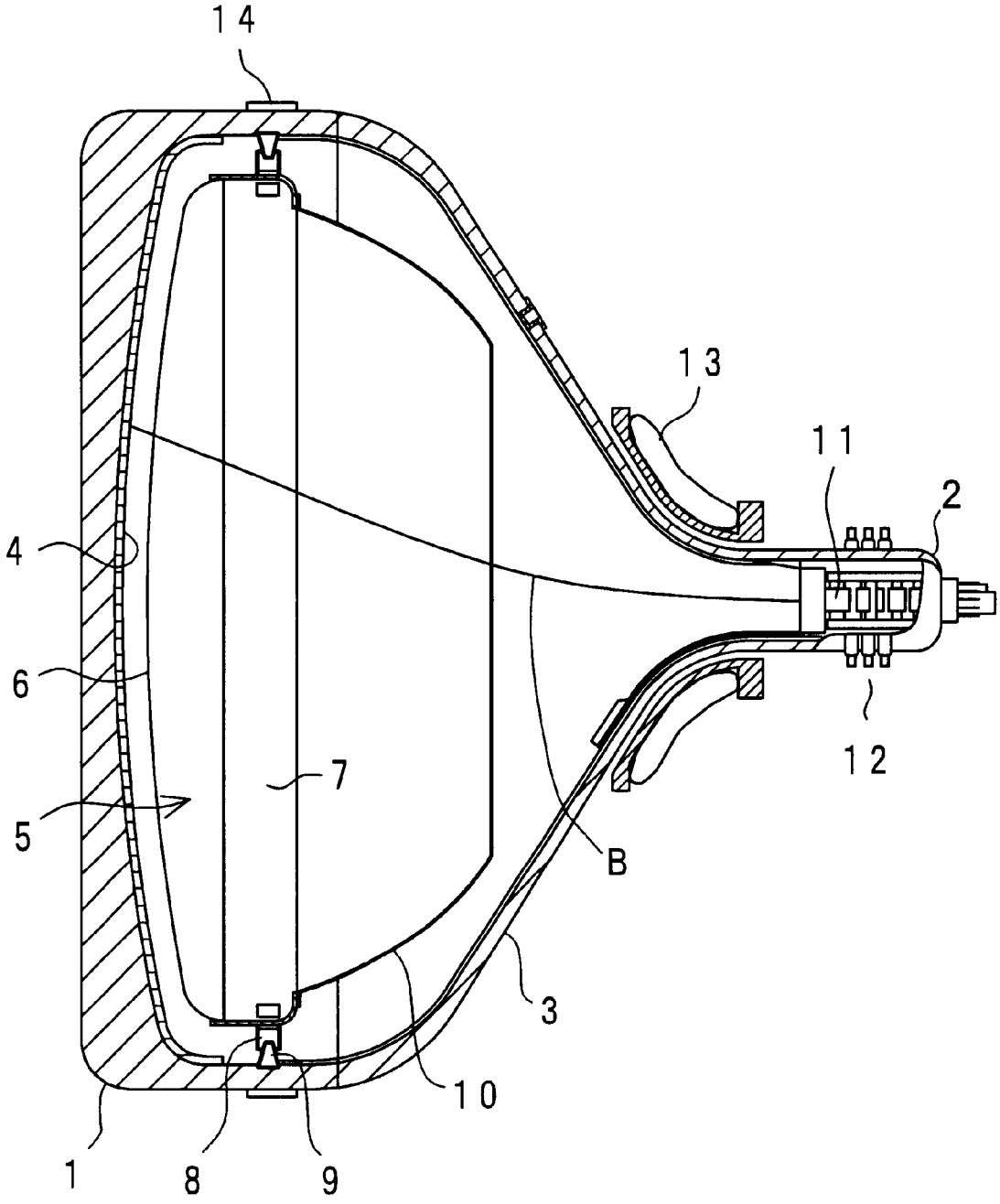
FIG. 1 is a schematic cross-sectional view explaining the entire constitution of a color cathode ray tube according to the present invention.

FIG. 1 is a schematic cross-sectional view explaining the entire constitutions of a color cathode ray tube of the present invention. This color cathode ray tube is of a flat panel type whose outer surface has the radius of curvature larger than the radius of curvature of an inner surface thereof. The shadow mask 6 is a so-called press mask having a curved surface which approximately traces the curved surface condition of an inner surface of the panel 1.

An approximately rectangular screen (a phosphor screen) is formed on the inner surface of the panel 1 by coating a phosphor film 4 made of tricolor phosphor dots thereon. A shadow mask structural body 5 is disposed in the vicinity of this phosphor film 4.

The shadow mask structural body 5 is constituted by welding the shadow mask 6 made of Invar material and having a thickness of 0.13 mm to a mask frame 7 made of steel and having a thickness of 1.2 mm. Suspension mechanisms 8 which are provided with spring members are mounted on side surfaces of the mask frame 7 and these suspension mechanisms 8 are engaged with stud pins 9 embedded into the inner side walls of the panel 1 thus mounting the mask frame 7 in place in a suspended form.

The panel 1 is adhered to a large diameter opening side of a funnel 3, while a small diameter opening side of the funnel 3 is connected to a neck 2. An electron gun 11 which emits three electron beams B is accommodated in the inside of the neck 2. An external magnetic device 12 provided for color purity correction or the like is disposed around the neck portion 2. On a transient region between the funnel 3 and the neck 2, a deflection yoke 13 is exteriorly mounted. The deflection yoke 13 deflects the electron beams B in the horizontal direction as well as In the vertical direction. By performing the scanning in two directions on the phosphor film 4, image are reproduced. A magnetic shield 10 is fixedly secured to the neck side of the mask frame 7 for shielding the electron beams B from an external; magnetism such as an earth magnetism or the like.

Figure 2:
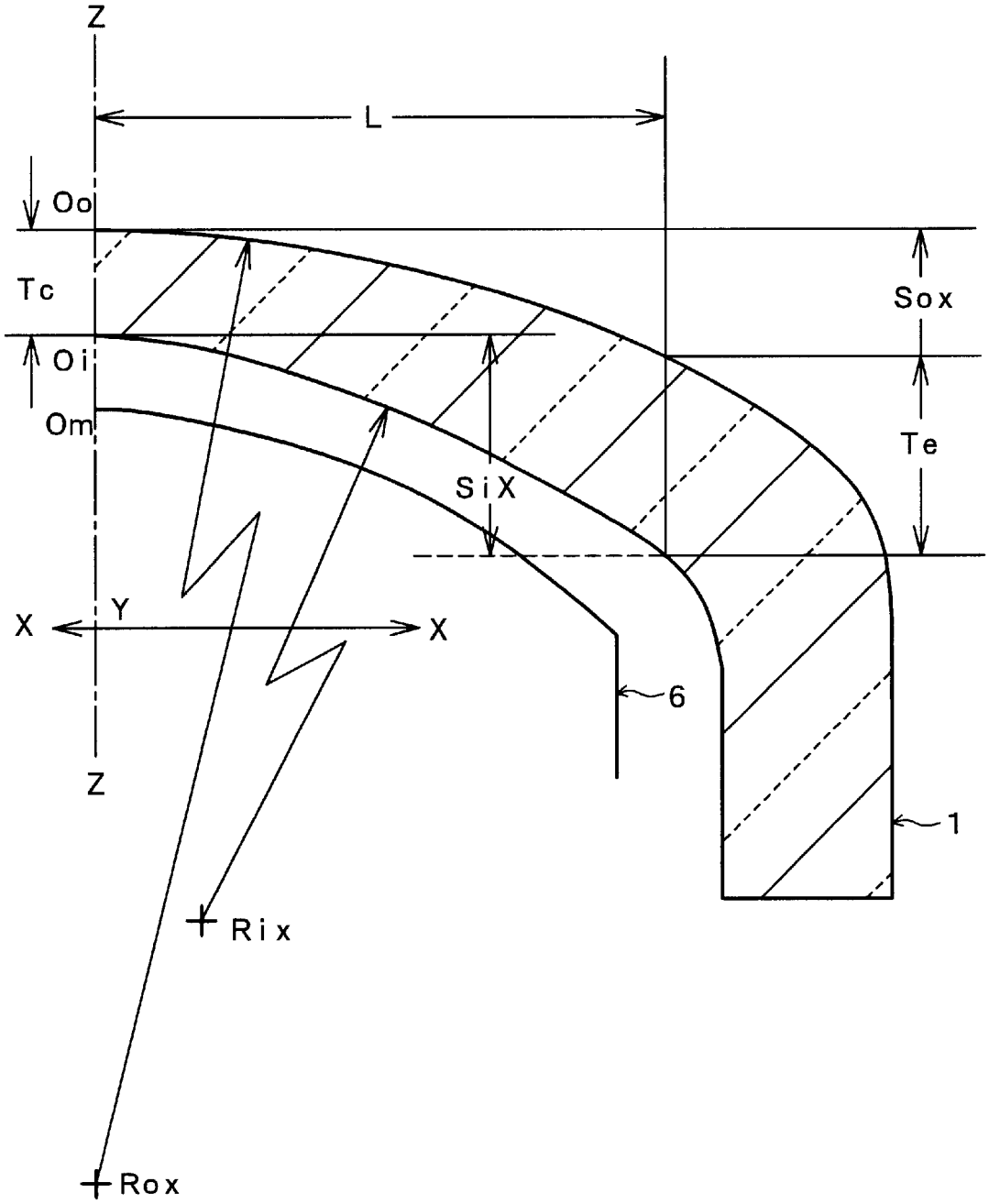
FIG. 2 is a partial cross-sectional view explaining the definition of the equivalent radii of curvature which expresses the curved surfaces of inner and outer surfaces of a panel and shadow mask.

FIG. 2 is a partial cross-sectional view explaining the detailed shape of the panel and the shadow mask. In FIG. 2, to facilitate the understanding of the explanation, the outer surface of the panel 1 has a shape which is warped more compared to the outer shape shown in FIG. 1. In FIG. 2, an axis which extends in the electron beam advancing direction when the electron beams are not deflected in the cathode ray tube and passes through the center of the screen (phosphor surface) is set as a Z axis (tube axis), an axis which extends in the main scanning direction (horizontal direction) of the electron beams and passes through the Z axis is set as an X axis, and an axis which extends in the direction (vertical direction) which intersects the main scanning direction of the electron beams at a right angle and passes through the Z axis is set as a Y axis. An X axis—Y axis plane intersects the Z axis at a right angle and the centers of the inner and outer surfaces (the center of contour) of the panel 1 approximately agree with the Z axis.

By setting an intersecting point of the outer surface of the panel 1 with the Z axis as an outside origin $O_o$ and by setting a fall amount in the Z axis direction from the outside origin $O_o$ at an arbitrary point (x, y) in the phosphor surface region of the outer surface of the panel 1 as $z_o$, the curved surface shape of the outside surface of the panel 1 is generally defined by a following formula.

$$z_o=A1x^2+A2x^4+A3y^2+A4y^4+A5x^2y^2+A6x^2y^4+A7x^4y^2+A8x^4y^4 \text{ (A1 to A8 being coefficients)}$$

Then, by determining the coefficients A1 to A8, a desired curved surface shape can be obtained.

Further, also with respect to the curved surface shape of the inner surface of the panel 1, by setting an intersecting point of the inner surface of the panel 1 with the Z axis as an inside origin $O_i$ and by setting a fall amount in the Z axis direction from the inside origin $O_i$ at an arbitrary point (x, y) in the phosphor surface region of the inner surface of the panel 1 as $z_i$, the curved surface shape of the inside surface of the panel 1 can be defined in the same manner by replacing $z_o$ with $z_i$.

Further, also with respect to the curved surface shape of the shadow mask 6, by setting an intersecting point of the shadow mask 6 with the Z axis as a mask origin $O_m$ and by setting a fall amount in the Z axis direction from the mask origin $O_m$ at an arbitrary point (x, y) in the apertures region of the shadow mask 6 as $Z_m$, the curved surface shape of the inside surface of the shadow mask 6 can be defined in the same manner by replacing $z_o$ with $z_m$.

Further, the curved surface shape of the outer surface of the panel 1 may be generally defined by a following formula.

$$z_o=R_{ox}-\{(R_{ox}-R_{oy}+(R_{oy}^2-y^2)^{1/2})^2-x^2\}^{1/2} \quad (1)$$

$$z_o=R_{ox}-(R_{ox}^2-x^2)^{1/2}+R_{oy}-(R_{oy}^2-y^2)^{1/2} \quad (2)$$

Here, $R_{ox}$ represents the radius of curvature along the axis X on the outer surface of the panel 1 and $R_{oy}$ represents the radius of curvature along the axis Y on the outer surface of the panel 1. The formula (1) expresses the curved surface shape having the uniform curvature in the radial direction and the formula (2) expresses the curved surface shape having the uniform curvature respectively in the X axis direction and the Y axis direction.

Further, the curved surface shape of the inner surface of the panel 1 is also defined in the similar manner by replacing "o" with "i".

The curved surface obtained by the above-mentioned formulae is a non-spherical shape in many cases and the radius of curvature differs depending on the arbitrary position on the curved surface. Then, the curvatures (radii of curvature) of the panel and the shadow mask are defined by the equivalent radii of the curvature.

The equivalent radii of curvature which express the curved surfaces of the inner and outer surfaces of the panel are explained in conjunction with FIG. 2. In FIG. 2, L indicates a distance in the direction which intersects the axis Z at a right angle from the center (Z axis) of the panel 1 to the ends of the display region (screen); in the X axis direction, $T_c$ indicates a thickness in the Z axis direction (panel thickness) at the center of the panel, $T_e$ indicates a thickness in the Z axis direction at the ends of the display region in the X axis direction, $S_{ox}$ is a fall amount in the Z axis direction between the center $O_o$ of the outer surface of the panel and the peripheries (ends of the display region) in the X axis direction, $S_{ix}$ is a fall amount in the Z axis direction between the center $O_i$ of the inner surface of the panel and the peripheries (ends of the display region) in the X axis direction, $R_{ox}$ is the equivalent radius of curvature on the outer surface in the X axis direction of the panel and $R_{ix}$ is the equivalent radius of curvature on the inner surface in the X axis direction of the panel.

Here, following relationships exist between $R_{ox}$, $R_{ix}$, $S_{ox}$, $S_{ix}$ and L. $R_{ox}=(S_{ox}^2+L^2)/(2S_{ox})$, $R_{ix}=(S_{ix}^2+L^2)/(2S_{ix})$ That is, the equivalent radius of curvature is the radius of curvature determined by the distance L-from the center (the intersecting point with the Z axis) of the panel 1 shown in FIG. 2 to the ends of the display region and the fall amounts $S_{ox}$, $S_{ix}$ between the center and the peripheries (ends of the display region).

Although the above-mentioned equivalent radius of curvature is defined by taking the radius of curvature in the X direction of the panel as an example, the radius of curvature in other direction can be defined in the same manner. Further, the equivalent radius of curvature of the shadow mask 6 can be defined in the same manner.

Even when panels have the same curvature, depending on the size of the effective screen, panels (planar surface)look flat to human eyes in one case and panels do not look flat to human eyes in the other case.

Then, a following method can be used as a method for evaluating the visibility characteristics (flatness of the panel as seen by human eyes). That is, irrespective of the size of the screen, the equivalent radius of curvature $R_i$ of the inner surface of the standardized panel is set such that $R_i$=40V+40 and the equivalent radius of curvature $R_o$ of the outer surface of the standardized panel is set such that $R_o$=42.5V+45. Here, V means a 'Visual Size' which expresses the effective diameter of the screen in the diagonal direction in inch. For example, the value of V is 20 with respect to the color cathode ray tube of the nominal 21 inches (the diagonal effective diameter of the screen being 51 cm).

Then, the degree of the flatness is expressed by a multiple of the equivalent radius of curvature $R_o$ of the outer surface of the above-mentioned standardized panel or the equivalent radius of curvature $R_i$ of the inner surface of the above-mentioned standardized panel.

In the present invention, by setting the equivalent radius of curvature in the diagonal direction in the phosphor surface of the outer surface of the panel to equal to or more than $10R_o$, the screen is made to look approximately flat. Further, by setting the equivalent radius of curvature to equal to or more than $20R_o$, the screen substantially looks completely flat.

To the contrary, the equivalent radius of curvature in the diagonal direction in the phosphor surface region of the inner surface of the panel is set to equal to or less than $4R_i$ in view of the manufacturing limitation due to the press molding technique of the shadow mask having the curved surface which approximately follows the inner surface of the panel. By setting the equivalent radius of curvature to equal to or less than $3R_i$, the press forming of the shadow mask can be made further easier. Then, by setting the equivalent radii of the curvature along the long axis direction and along the short axis direction in the phosphor region of the inner surface of the panel to equal to or less than 3000 mm respectively, the dimensional accuracy of the curved surface of the shadow mask by a press molding is enhanced so that the manufacturing yield of the shadow masks when assembled into the color cathode ray tubes becomes stable.

Here, the equivalent radii of curvature along the long axis direction and along the short axis direction in the apertures region of the shadow mask per se is set to equal to or less than 3000 mm so that a desired curved shape can be maintained.

However, when the above-mentioned equivalent radius of curvature of the inner surface of the panel is set to an excessively small value, the difference between the equivalent radius of curvature of the inner surface of the panel and the equivalent radius of curvature of the outer surface of the panel becomes large so that the glass thickness of the panel in the peripheral portion of the screen becomes thick, and hence the brightness of the image at this portion is reduced. In the present invention, to reduce the difference of brightness between the central portion and the peripheral portion of the screen of the cathode ray tube, the equivalent radius of curvature in the diagonal direction in the phosphor surface region of the inner surface of the panel is set larger than $2R_i$. Meanwhile, the equivalent radii of curvature along the long axis direction and the short axis direction in the phosphor surface region of the inner surface of the panel are respectively set to equal to or more than 1500 mm.

Here, the equivalent radii of curvature of the shadow mask per se respectively along the long axis direction and along the short axis direction are set to equal to or more than 1250 mm. Thus, the increase of the distance between the inner surface of the panel and the shadow mask in the peripheral portion of the screen can be suppressed so that the landing shift of the electron beams to the phosphor pixels due to the influence of the earth magnetism can be reduced.

Figure 3:
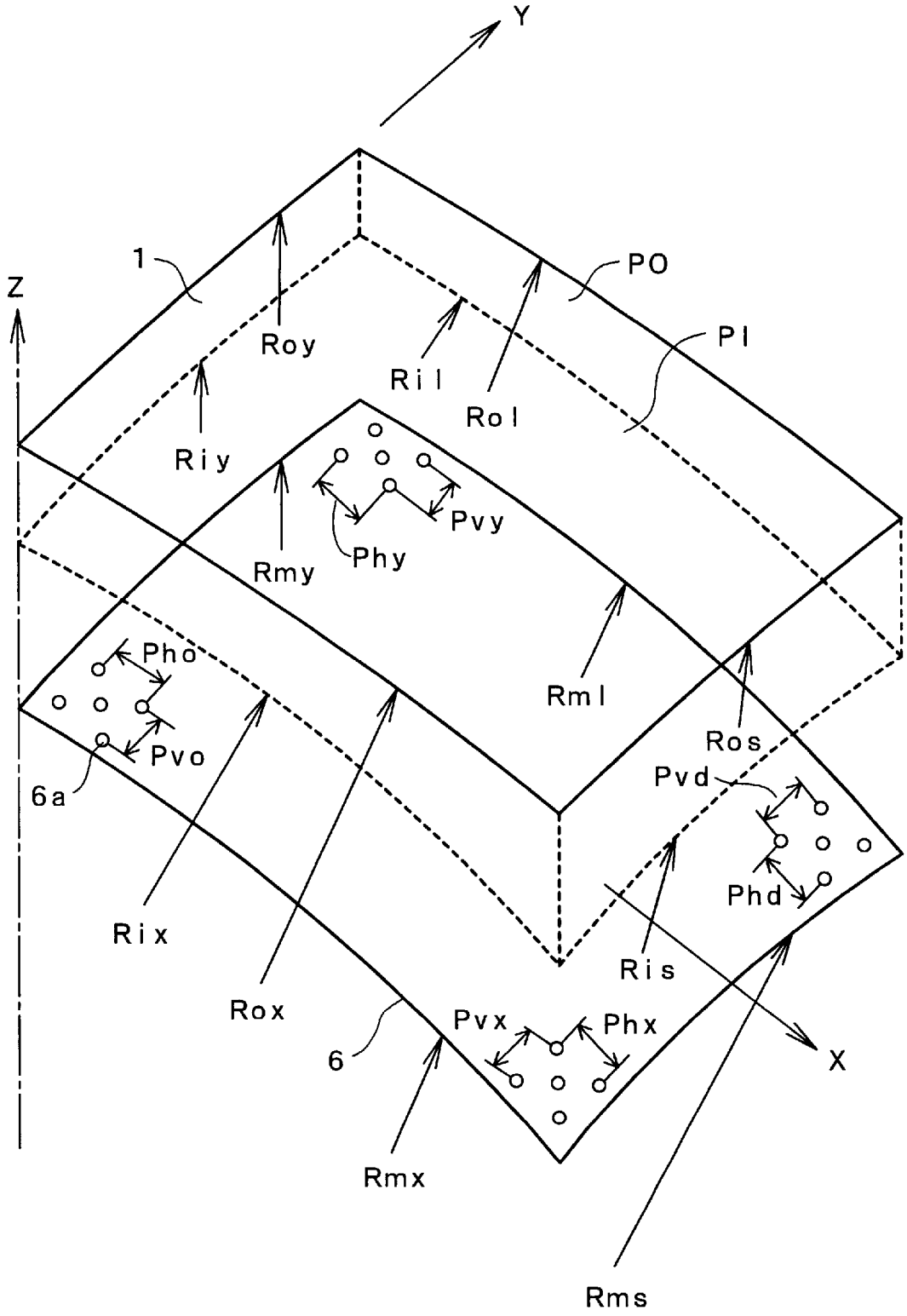
FIG. 3 is a schematic view showing the cross section of an essential part of a panel to explain one embodiment of the flat panel type color cathode ray tube of the present invention.

FIG. 3 is a schematic view showing a cross section of an essential part of the panel and the shadow mask for explaining the first embodiment of the flat panel type color cathode ray tube of the present invention. The color cathode ray tube includes a vacuum envelope which is constituted by a panel provided with a phosphor layer on an inner surface thereof, a neck which accommodates an electron gun therein, and a funnel which connects the panel with the neck. An approximately rectangular screen (phosphor screen) is formed on the inner surface of the panel. An axis which extends in the electron beam advancing direction when the electron beams are not deflected in the cathode ray tube and passes through the center of the screen (phosphor surface) is set as a Z axis, an axis which extends in the main scanning direction (horizontal direction) of the electron beams on the panel which forms the screen and passes through the Z axis is set as an X axis (long axis), and an axis which extends in the direction (vertical direction) which intersects the main scanning direction of the electron beams at a right angle and passes through the Z axis is set as a Y axis (short axis). The Z axis (tube axis) intersects an X-Y plane at a right angle.

In FIG. 3, numeral 1 indicates a panel. In a one-fourth portion of the panel 1 on an X-Y plane perpendicular to the tube axis Z, only an effective region (a phosphor surface forming portion) of the panel 1 is schematically shown. Numeral 6 indicates a shadow mask. A one-fourth portion of the shadow mask 6 is shown as in the case of the panel 1 and this portion forms an apertures region (an electron beam passing aperture forming portion) of the shadow mask.

In FIG. 3, the outer surface of the panel 1 is shown by a dashed line PO while the inner surface of the panel 1 is shown by a broken line PI. The equivalent radius of curvature of the outer surface PO of the panel 1 along the X axis is set as $R_{ox}$, the equivalent radius of curvature of the outer surface PO of the panel 1 along the Y axis is set as $R_{oy}$ the equivalent radius of curvature along a long side portion which passes at an end portion of the effective area along the Y axis in the horizontal direction is set as $R_{ol}$, and the equivalent radius of curvature along a short side portion which passes at an end portion of the effective area along the X axis in the vertical direction is set as $R_{os}$. Then, the equivalent radius of curvature of the inner surface PI of the panel 1 along the X axis is set as $R_{ix}$, the equivalent radius of curvature of the inner surface PI of the panel 1 along the Y axis direction is set as $R_{iy}$, the equivalent radius of curvature along a long side portion which passes at an end portion of the effective area along the Y axis in the horizontal direction is set as $R_{il}$, and the equivalent radius of curvature along a short side portion which passes at an end portion of the effective area along the X axis in the vertical direction is set as $R_{is}$.

Meanwhile, the equivalent radius of curvature of the shadow mask 6 along the X axis is set as $R_{mx}$, the equivalent radius of curvature of the shadow mask 6 along the Y axis is set as $R_{my}$, the equivalent radius of curvature along a long side portion which passes an end portion of the apertures region along the Y axis in the horizontal direction is set as $R_{ml}$, and the equivalent radius of curvature along a short side portion which passes an end portion of the apertures region along the X axis in the vertical direction is set as $R_{ms}$. The shadow mask 6 is provided with a large number of dot-type electron beam passing apertures 6*a* and the horizontal directional arrangement pitch of these beam apertures, 6*a* is set as $P_{ho}$ at the central portion of the approximately rectangular apertures region of the shadow mask, $P_{hx}$ at the peripheral portion of the apertures region along the X axis, $P_{hy}$ at the peripheral portion of the apertures region along the Y axis, and $P_{hd}$ at the corner portion of the apertures region respectively.

In the first embodiment of the present invention, the relationship between the equivalent radius of curvature $R_{ox}$ along the X axis of the outer surface PO of the panel 1 and the equivalent radius of curvature $R_{oy}$ along the Y axis of the outer surface PO of the panel 1 and the relationship between the equivalent radius of curvature $R_{ix}$ along the X axis of the inner surface PI of the panel 1 and the equivalent radius of curvature $R_{iy}$ along the Y axis of the inner surface PI of the panel 1 are respectively set such that $R_{ox}<R_{oy}$ and $R_{ix}>R_{iy}$.

In this embodiment, the color cathode ray tube in which the effective diameter of the screen in the diagonal direction is 51 cm, the maximum deflection angle of the electron beams is 90 degrees and the outer diameter of the neck is 29.1 mm adopts the following specification on the curved surface of the panel. That is, the equivalent radius of curvature $R_{ox}$ along the X axis of the outer surface PO of the panel 1 is set such that $R_{ox}$=50000 mm, the equivalent radius of curvature $R_{oy}$ along the Y axis of the outer surface PO is set such that $R_{oy}$=80000 mm, the equivalent radius of curvature $R_{od}$ along the diagonal line of the outer surface PO is set such that $R_{od}$=57803.4 mm, the equivalent radius of curvature $R_{iy}$ along the Y axis of the inner surface PI of the panel 1 is set such that $R_{iy}$=1870 mm, the equivalent radius of curvature $R_{ix}$ along the X axis of the inner surface PI of the panel 1 is set such that $R_{ix}$=1990 mm, and the equivalent radius of curvature $R_{id}$ along the diagonal line of the inner surface PI is set such that $R_{id}$=1945.2 mm.

By defining the curved surface shape on axes on the inner and outer surfaces of the panel in this manner, the feeling of flatness of the screen formed on the panel 1 in the short axis (Y axis) direction, particularly, at the short side (end in the X axis direction) is enhanced. Simultaneously, the mechanical strength of the shadow mask which having the curved surface which follows the inner surface of the panel can be reinforced so that the color cathode ray tube having the improved visibility characteristics and the impact resistance characteristics can be obtained. Further, since the curved surface shape of if the inner surface of the panel 1 is formed such that the equivalent radius of curvature in the X direction is different from the equivalent radius of curvature in the Y direction, the explosion-proof characteristics of the glass envelope which incorporates such a panel 1 can be improved compared to a panel having a curved surface shape whose equivalent radii of curvature in the X direction and in the Y direction are equal.

Further, in this embodiment, the ratio $(R_{iy}/R_{ix})$ between the equivalent radius of curvature $R_{iy}$ along the Y axis and the equivalent radius of curvature $R_{ix}$ along the X axis of the inner surface PI of the panel 1 is set such that it falls within the range of $0.7<(R_{iy}/R_{ix})<1.0$.

Figure 4:
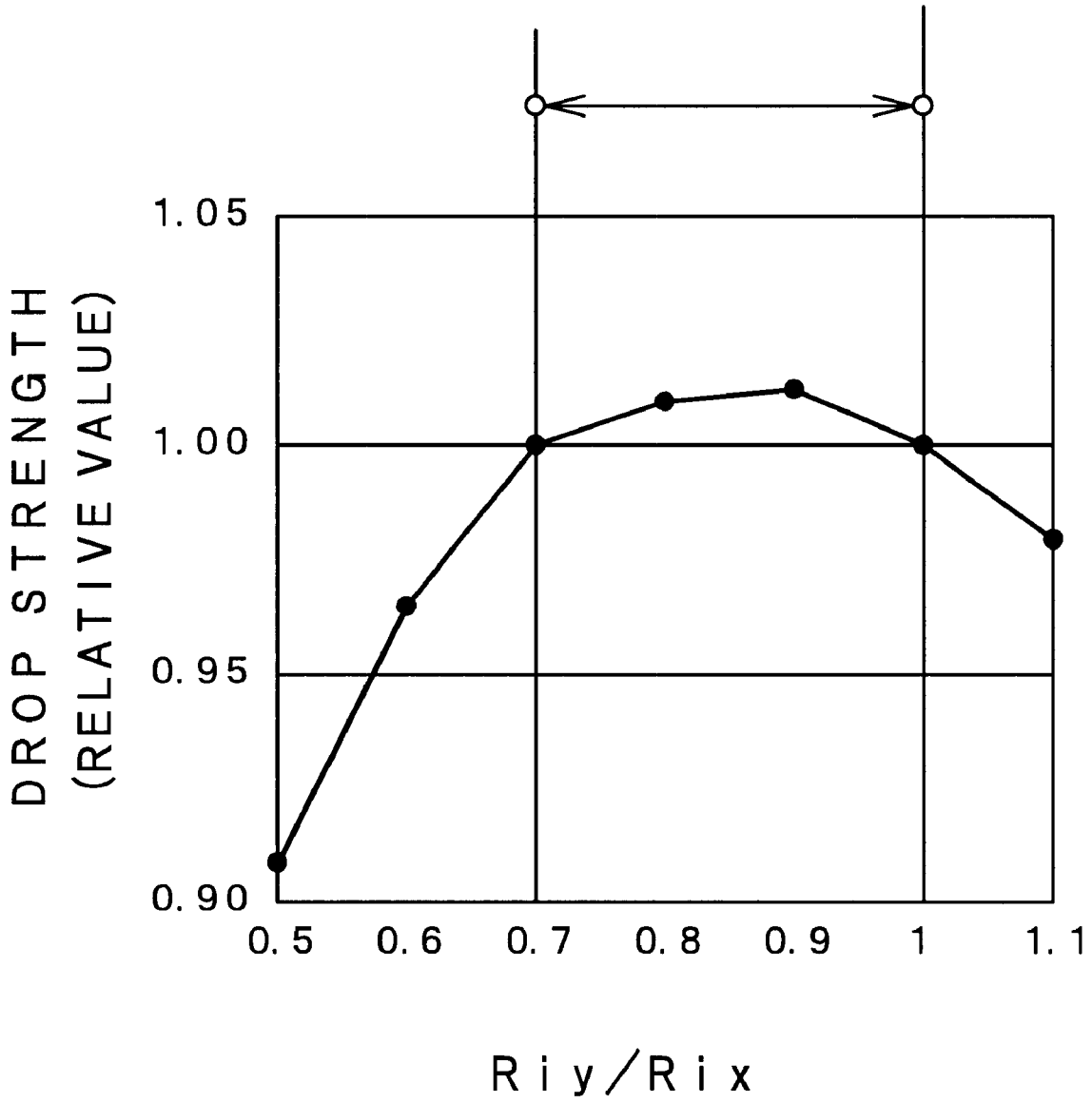
FIG. 4 is an explanatory view showing the result of an analysis of a drop strength test of a shadow mask when the ratio between an equivalent radius of curvature along an X axis and an equivalent radius of curvature along a Y axis of an inner surface of the panel is varied.
Figure 5:
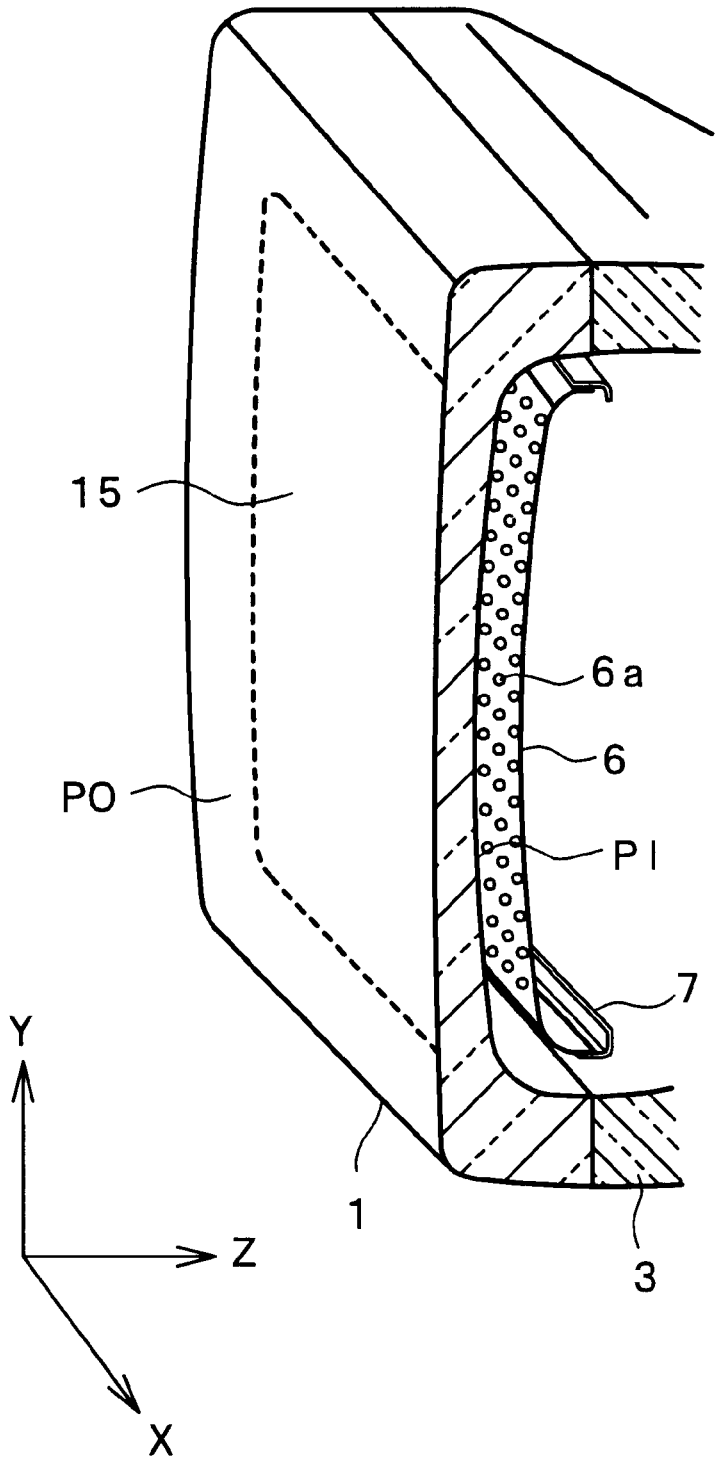
FIG. 5 is a schematic cross-sectional view of an essential portion explaining a structural example of a flat panel type color cathode ray tube.

FIG. 4 is an explanatory view showing the result of an analysis of a drop strength experiment of the shadow mask when the ratio between the equivalent radius of curvature along the X axis and the equivalent radius of curvature along the Y axis on the inner surface of the panel is varied. Here, the drop strength of the shadow mask means the yield strength until the shadow mask starts its deformation when it is dropped with the protruding surface of the panel directed upwardly.

In FIG. 4, the ratio $(R_{iy}/R_{ix})$ between the equivalent radius of curvature $R_{ix}$ (mm) along the X axis and the equivalent radius of curvature $R_{iy}$ (mm) along the Y axis of the inner surface PI of the panel 1 when the equivalent radius of curvature Rid along the diagonal direction of the effective region of the inner surface of the panel is fixed 2000 mm is taken on the axis of abscissas and the drop strength expressed as a relative value which becomes 1 when $R_{ix}=R_{iy}$ is taken on the axis of ordinates.

As shown in FIG. 4, it is understood that the drop strength becomes large when the ratio $(R_{iy}/R_{ix})$ between the equivalent radius of curvature along the X axis and the equivalent radius of curvature along the Y axis of the inner surface of the panel falls in the range from 0.7 to 1.0.

Further, by making the ratio $(R_{iy}/R_{ix})$ between the equivalent radii of curvature along the axes fall in the range from 0.75 to 0.95, simultaneous with the enhancement of the mechanical strength of the shadow mask, the explosion-proof characteristics of the glass envelope which incorporates such a shadow mask is further improved.

Particularly, it was proved that the strength of the shadow mask in the drop test takes the maximum value when the ratio $(R_{iy}/R_{ix})$ on the condition that the curvature in the diagonal direction of the shadow mask is fixed is in the vicinity of 0.9.

In the second embodiment of the present invention, the relationship between the equivalent radius of curvature $R_{ol}$ along the long side portion of the outer surface PO of the panel 1 and the equivalent radius of curvature $R_{os}$ along the short side portion of the outer surface PO of the panel 1 and the relationship between the equivalent radius of curvature $R_{il}$ along the long side portion of the inner surface PI of the panel 1 and the equivalent-radius of curvature $R_{is}$ along the short side portion of the inner surface PI of the panel 1 are respectively set such that $R_{ol}<R_{os}$ and $R_{il}>R_{is}$.

According to this embodiment, a color cathode ray tube having the same size as that of the first embodiment adopts the following specification on the curved surface of the panel. That is, the equivalent radius of curvature $R_{ol}$ along the long side portion of the outer surface PO of the panel 1 is set such that $R_{ol}$=49999.9 mm, the equivalent radius of curvature $R_{os}$ along the short side portion of the outer surface PO is set such that $R_{os}$=79999.4 mm, the equivalent radius-of curvature $R_{il}$ along the long side portion of the inner surface PI of the panel 1 is set such that $R_{il}$=1984 mm, and the equivalent radius of curvature $R_{is}$ along the short side portion of the inner surface PI of the panel 1 is set such that $R_{is}$=1860.5 mm.

Further, in this embodiment, the result of an analysis on the shadow mask drop strength similar to that of the above-mentioned first embodiment can be also obtained. In the test, the ratio between the equivalent radius of curvature $R_{il}$ along the long side portion and the equivalent radius of curvature $R_{is}$ along the short side portion of the inner surface PI of the panel 1 is set to fall in the range of $0.7<(R_{is}/R_{il})<1.0$.

In this manner, by defining the curved surface shape in the periphery of the inner and outer surfaces of the panel, the color cathode ray tube having the improved visibility characteristics and the improved impact resistance characteristics can be obtained in the same manner as the first embodiment. Further, by adding the relationship $R_{ix}>R_{iy}$ between the equivalent radii of curvature along the X axis and Y axis of the inner surface PI of the panel 1 of the above-mentioned first embodiment, the feeling of flatness of the screen and the mechanical strength of the shadow mask are effectively enhanced.

In the third embodiment of the present invention, the relationship between the equivalent radius of curvature $R_{mx}$ along the X axis of the shadow mask 6 and the equivalent radius of curvature $R_{my}$ along the Y axis of the shadow mask 6 is set such that $R_{mx}>R_{my}$. Due to such a constitution, the mechanical strength of the shadow mask can be also reinforced in the same manner as the above-mentioned first embodiment.

Here, the arrangement pitch of electron beam passing apertures 6*a* of a shadow mask 6 in the horizontal direction is substantially set to a uniform pitch along the X direction such that the difference between the pitch $P_{ho}$ at the central portion and the pitch $P_{hx}$ at the end portion along the X axis becomes equal to or less than 0.01 mm. Due to such a constitution, the sufficient resolution of the displayed image at the short side portion of the screen is assured.

In this embodiment, the result of an analysis on the shadow mask drop strength similar to that of the above-mentioned first embodiment can be also obtained. In the test, the ratio between the equivalent radius of curvature $R_{mx}$ along the X axis and the equivalent radius of curvature $R_{my}$ along the Y axis of the shadow mask 6 is set to fall in the range of $0.7<(R_{my}/R_{mx})<1.0$.

In this manner, by defining the curved surface shape on the axes and the arrangement of the electron beam passing apertures on the shadow mask, the color cathode ray tube having the improved impact resistance characteristics and the improved image quality characteristics can be obtained. Further, by adding the definition of the curved surface shape on the axes of the outer surface of the panel of the above-mentioned first embodiment, the feeling of flatness of the screen is enhanced and the favorable visibility characteristics can be obtained as in the case of the first embodiment.

In the fourth embodiment of the present invention, the relationship between the equivalent radius of curvature $R_{ml}$ along the long side portion of the shadow mask 6 and the equivalent radius of curvature $R_{ms}$ along the short side portion of the shadow mask 6 is set such that $R_{ml}>R_{ms}$. Due to such a constitution, the mechanical strength of the shadow mask can be also reinforced as in the case of the second embodiment.

Here, the arrangement pitch of electron beam passing apertures of a shadow mask 6 in the horizontal direction is substantially set to a uniform pitch along the long side portion such that the difference between the pitch $P_{hy}$ at the end portion along the Y axis and the pitch $P_{hd}$ at the corner portion becomes equal to or less than 0.01 mm. Due to such a constitution, the sufficient resolution of the displayed image at the corner portion of the screen is assured.

In this embodiment, the result of an analysis on the shadow mask drop strength similar to that of the above-mentioned first embodiment can be also obtained. In the test, the ratio between the equivalent radius of curvature $R_{ml}$ along the long side portion and the equivalent radius of curvature $R_{ms}$ along the short side portion of the shadow mask 6 is set to fall in the range of $0.7<(R_{ms}/R_{ml})<1.0$.

In this manner, by defining the curved surface shape on the periphery and the arrangement of the electron beam passing apertures on the shadow mask, the color cathode ray tube having the improved impact resistance characteristics and the improved image quality characteristics can be obtained. Further, by adding the definition of the curved surface shape on the periphery of the outer surface of the panel of the above-mentioned second embodiment, the feeling of flatness of the screen is enhanced and the favorable visibility characteristics can be obtained as in the case of the second embodiment.

In the fifth embodiment of the present invention, the relationship between the arrangement pitch $P_{ho}$ of the electron beam passing apertures 6*a* in the horizontal direction at the central portion of the shadow mask 6 and the arrangement pitch $P_{hx}$ in the horizontal direction at the end portion along the X axis in the shadow mask 6 is set such that $P_{ho}<P_{hx}$. Here, these electron beam passing apertures 6*a* are arranged in a variable pitch such that the arrangement pitch in the horizontal direction is gradually increased from the central portion to the end portion along the X axis. Due to such a constitution, the landing tolerance of electron beams to the phosphor dots at the short side portion of the screen is enhanced and simultaneously the transmittance of the electron beam passing apertures can be enhanced at the short side portion of the shadow mask thus increasing the brightness of the displayed image at the short side portion of the screen.

Here, the equivalent radius of curvature $R_{mx}$ along the X axis in the shadow mask 6 is made smaller than that of the shadow mask having the uniform pitch in the above-mentioned third embodiment and the relationship between the equivalent radius of curvature $R_{mx}$ along the X axis and the equivalent radius of curvature $R_{my}$ along the Y axis of the shadow mask 6 is set such that $R_{mx}<R_{my}$. Due to such a constitution, the mechanical strength of the shadow mask particularly in the X axis direction can be reinforced compared to the shadow mask having the uniform pitch of the above-mentioned third. embodiment.

According to this embodiment, a color cathode ray tube having the same size as that of the first embodiment adopts the following specification on the curved surface of the shadow mask. That is, the arrangement pitch $P_{ho}$ of the electron beam passing apertures 6*a* in the horizontal direction at the central portion of the shadow mask is set such that $P_{ho}$=0.4100 mm, the arrangement pitch $P_{hx}$ of the electron beam passing apertures 6*a* in the horizontal direction at the end portion along the X axis is set such that $P_{hx}$=0.4515 mm, the equivalent radius of curvature $R_{mx}$ along the X axis is set such that $R_{mx}$=1647 mm, the equivalent radius of curvature $R_{my}$ along the Y axis is set such that $R_{my}$=2034 mm, and the equivalent radius of curvature $R_{md}$ along the diagonal direction is set such that $R_{md}$=1746 mm.

Further, in this embodiment, the ratio between the arrangement pitch $P_{ho}$ of the electron beam passing apertures 6*a* in the horizontal direction at the central portion of the shadow mask 6 and the arrangement pitch $P_{hx}$ in the horizontal direction at the end portion along the X axis in the shadow mask 6 is set such that $1.05<(P_{hx}/P_{ho})<1.4$. Due to such a constitution, the mechanical strength of the shadow mask is further enhanced and simultaneously the deterioration of the resolution of the displayed image at then short side portion of the screen can be suppressed.

In this manner, by defining the arrangement of the electron beam passing apertures and the curved surface shape on the axes on the shadow mask, the color cathode ray tube having the improved image quality characteristics and the improved impact resistance characteristics can be obtained. Further, by adding the definition of the curved surface shape on the axes of the inner and outer surfaces of the panel of the above-mentioned first embodiment, the feeling of flatness of the screen is enhanced and simultaneously the mechanical strength of the shadow mask is effectively reinforced as in the case of the first embodiment.

In the sixth embodiment of the present invention, the relationship between the arrangement pitch $P_{hy}$ of the electron beam passing apertures 6*a* in the horizontal direction at the end portion along the Y axis of the shadow mask 6 and the arrangement pitch $P_{hd}$ in the horizontal direction at the corner portion of the shadow, mask 6 is set such that $P_{hy}<P_{hd}$. Here, these electron beam passing apertures 6*a* are arranged in a variable pitch such that the arrangement pitch in the horizontal direction is gradually increased from the end portion along the Y axis to the corner portion. Due to such a constitution, the landing tolerance of electron beams to the phosphor dots at the corner portion of the screen is enhanced and simultaneously the transmittivity of the electron beam passing apertures at the corner portion of the shadow mask can be enhanced thus increasing the brightness of the displayed image at the corner portion of the screen.

Here, the equivalent radius of curvature $R_{ml}$ along the long side portion of the shadow mask 6 is made smaller than that of the shadow mask having the uniform pitch in the above-mentioned third embodiment and the relationship between the equivalent radius of curvature $R_{ms}$ along the short side portion and the equivalent radius of curvature $R_{ml}$ along the long side portion of the shadow mask 6 is set such that $R_{ml}<R_{ms}$. Due to such a constitution, the mechanical strength of the shadow mask particularly in the long side direction can be reinforced compared to the shadow mask having the uniform pitch of the above-mentioned third embodiment.

According to this embodiment, a color cathode ray tube having the same size as that of the first embodiment adopts the following specification on the curved surface of the shadow mask. That is, the arrangement pitch $P_{hy}$ of the electron beam passing apertures 6*a* in the horizontal direction at the end portion along the Y axis of the shadow mask is set such that $P_{hy}$=0.4131 mm, the arrangement pitch $P_{hd}$ of the electron beam passing apertures 6*a* in the horizontal direction at the corner portion of the shadow mask is set such that $P_{hd}$=0.4541 mm, the equivalent radius of curvature $R_{ml}$ along the long side portion is set such that $R_{ml}$=1609 mm, and the equivalent radius of curvature $R_{ms}$ along the short side portion is set such that $R_{ms}$=1937 mm.

Further, in this embodiment, the ratio between the arrangement pitch $P_{hy}$ of the electron beam passing apertures 6*a* in the horizontal direction at the end portion along the Y axis of the shadow mask 6 and the arrangement pitch $P_{hd}$ in the horizontal direction at the corner portion of the shadow mask 6 is set such that $1.05<(P_{hd}/P_{hy})<1.4$. Due to such a constitution, the mechanical strength of the shadow mask is further enhanced and simultaneously the deterioration of the resolution of the displayed image at the corner portion of the screen can be suppressed.

In this manner, by defining the arrangement of the electron beam passing apertures and the curved surface shape at the periphery of the shadow mask, the color cathode ray tube having the improved image quality characteristics and the improved impact resistance characteristics can be obtained. Further, by adding the definition of the curved surface shape on the periphery of the inner and outer surfaces of the panel of the above-mentioned second embodiment, the feeling of flatness of the screen is enhanced and simultaneously the mechanical strength of the shadow mask is effectively reinforced as in the case of the second embodiment.

In the seventh embodiment of the present invention, the relationship between the equivalent radius of curvature $R_{ox}$ along the X axis of the outer surface PO of the panel 1 and the equivalent radius of curvature $R_{ol}$ along the long side portion of the outer surface PO of the panel 1 and the relationship between the equivalent radius of curvature $R_{oy}$ along the Y axis of the outer surface PO of the panel 1 and the equivalent radius of curvature $R_{os}$ along the short side portion of the outer surface PO of the panel 1 are respectively set such that $R_{ox}\geqq R_{ol}$ and $R_{oy}\geqq R_{os}$. Due to such a constitution, no fourth non-spherical component is formed on the outer curved surface of the panel and the pin distortion of the displayed image and the reflection of outside light at the peripheral portion of the screen can be reduced. Further, the convergence characteristics for converging three electron beams at the peripheral portion of the screen is improved with high accuracy and this is particularly advantageous with respect to a color cathode ray tube for image display of high definition.

According to this embodiment, a color cathode ray tube having the same size as that of the first embodiment adopts the following specification on the curved surface of the panel. That is, the equivalent radius of curvature $R_{ox}$, along the X axis of the outer surface PO of the panel 1 is set such that $R_{ox}$=50000 mm, the equivalent radius of curvature $R_{ol}$ along the long side portion of the outer surface PO of the panel 1 is set such that $R_{ol}$=49999.9 mm, the equivalent radius of curvature $R_{oy}$ along the Y axis of the outer surface PO of the panel 1 is set such that $R_{oy}$=80000 mm, and the equivalent radius of curvature $R_{os}$ along the short side portion of the outer surface PO of the panel 1 is set such that $R_{os}$=79999.4 mm.

Further, in this embodiment, the ratio between the equivalent radius of curvature $R_{ox}$ along the X axis and the equivalent radius of curvature $R_{ol}$ along the long side portion of the outer surface PO of the panel 1 and the ratio between the equivalent radius of curvature $R_{oy}$ along the Y axis and the equivalent radius of curvature $R_{os}$ along the short side portion of the outer surface PO of the panel 1 are set to fall in the range of $0.8\leqq(R_{ol}/R_{ox})\leqq1.0$ and in the range of $0.8\leqq(R_{os}/R_{oy})\leqq1.0$ respectively. In this manner, by defining the lower limit of the ratio of radius of curvature between the axes and the periphery on the outer surface of the panel, the feeling of flatness at the peripheral portion of the screen can be maintained.

In this manner, by defining the curved surface shape on the axes and the periphery on the outer surface of the panel, the color cathode ray tube having the improved image quality characteristics and the improved visibility characteristics can be obtained. Further, by adding the definition of the curved surface shape on the axes or the periphery of the inner and outer surfaces of the panel of the above-mentioned first or second embodiment, the mechanical strength of the shadow mask is reinforced and simultaneously the feeling of flatness of the screen is effectively enhanced as in the case of the first or second embodiment.

In the eighth embodiment of the present invention, the relationship between the equivalent radius of curvature $R_{ix}$ along the X axis of the inner surface PI of the panel 1 and the equivalent radius of curvature $R_{il}$ along the long side portion of the inner surface PI of the panel 1 and the relationship between the equivalent radius of curvature $R_{iy}$ along the Y axis of the inner surface PI of the panel 1 and the equivalent radius of curvature $R_{is}$ along the short side portion of the inner surface PI of the panel 1 are respectively set such that $R_{ix}\geqq R_{il}$ and $R_{iy}\geqq R_{is}$. Due to such a constitution, no fourth non-spherical component is formed on the inner curved surface of the panel and the pin distortion of the displayed image and the reflection of outside light at the peripheral portion of the screen can be reduced. Further, the convergence characteristics for converging three electron beams at the peripheral portion of the screen is improved with high accuracy and this is particularly advantageous with respect to a color cathode ray tube for image display of high definition.

According to this embodiment, a color cathode ray tube having the same size as that of the first embodiment adopts the following specification on the curved surface of the panel. That is, the equivalent radius of curvature $R_{ix}$ along the X axis of the inner surface PI of the panel 1 is set such that $R_{ix}$=1990 mm, the equivalent radius of curvature $R_{il}$ along the long side portion of the inner surface PI of the panel 1 is set such that $R_{il}$=1984 mm, the equivalent radius of curvature $R_{iy}$ along the Y axis of the inner surface PI of the panel 1 is set such that $R_{iy}$=1870 mm, and the equivalent radius of curvature $R_{is}$ along the short side portion of the inner surface PI of the panel 1 is set such that $R_{is}$=1860.5 mm.

Further, in this embodiment, the ratio between the equivalent radius of curvature $R_{ix}$ along the X axis and the equivalent radius of curvature $R_{il}$ along the long side portion of the inner surface PI of the panel 1 and the ratio between the equivalent radius of curvature $R_{iy}$ along the Y axis and the equivalent radius of curvature $R_{is}$ along the short side portion of the inner surface PI of the panel 1 are set to fall in the range of $0.8 \leqq (R_{il/Rix}) \leqq 1.0$ and in the range of $0.8 \leqq (R_{is}/R_{iy}) \leqq 1.0$ respectively. In this manner, by defining the lower limit of the ratio of radius of curvature between the axes and the periphery on the inner surface of the panel, the feeling of flatness at the peripheral portion of the screen can be maintained.

In this manner, by defining the curved surface shape on the axes and the periphery on the inner surface of the panel, the color cathode ray tube having the improved image quality characteristics and the improved visibility characteristics can be obtained. Further, by adding the definition of the curved surface shape on the axes or the periphery of the inner and outer surfaces of the panel of the above-mentioned first or second embodiment, the mechanical strength of the shadow mask is reinforced and simultaneously the feeling of flatness of the screen is effectively enhanced as in the case of the first or second embodiment.

The electron beam passing apertures of the shadow masks in the above-mentioned respective embodiment are made of dot type apertures. Further, in the above-mentioned respective embodiments, the horizontal pitch of the electron beam passing apertures formed on the shadow mask may be set such that the pitch is a uniform pitch from the central portion to an intermediate portion along the X axis of the shadow mask and is a variable pitch which is gradually increased from the intermediate portion to the peripheral portion along the X axis. Due to such a constitution, the drop strength of the shadow mask can be increased and simultaneously the sufficient resolution of the displayed image in the region from the central portion to the intermediate portion of the screen is assured. Here, the above-mentioned uniform pitch is defined within the range which restricts the difference of the pitch at the central portion and the pitch at the intermediate portion to equal to or less than 0.01 mm. Further, the above-mentioned intermediate portion is within the range of ⅓ to ⅚ of the distance from the central portion to the end portion along the X axis.

Although these embodiments are applicable to color cathode ray tubes having any panel size, a further advantageous effect can be obtained by applying the embodiments to a flat panel type color cathode ray tube whose equivalent radius of curvature $R_{oy}$ in the Y axis direction, particularly at the short side on the outer surface of the panel is equal to or more than 10000 mm.

According to the above-mentioned embodiments, the flat panel type color cathode ray tube which has the improved feeling of flatness and the improved drop strength can be realized.

As has been described heretofore, according to one embodiment of the present invention, a color cathode ray tube which is provided with a shadow mask having the high resistance against the mechanical impact can be provided by setting the radii of curvature of the inner and outer surfaces of the panel to appropriate values which fall within the range which does not spoil the feeling of the flatness of the display image.

What is claimed is:

1. A color cathode ray tube including a vacuum envelope which is constituted by a panel provided with a phosphor layer on an inner surface thereof, a neck accommodating an electron gun and a funnel which connects said panel with said neck, wherein under the condition that an axis which passes a tube axis in a main scanning direction of a screen formed by said panel is set as an X axis, an axis which passes said tube axis in a direction perpendicular to said main scanning direction of the screen is set as a Y axis, an equivalent radius of curvature along the X axis in the screen region on an outer surface of said panel is set as $R_{ox}$, an equivalent radius of curvature along the Y axis in the screen region on the outer surface of said panel is set as $R_{oy}$, an equivalent radius of curvature along the Y axis in the screen region on the inner surface of said panel is set as $R_{iy}$, an equivalent radius of curvature along the X axis in the screen region on the inner surface of said panel is set as $R_{ix}$, the relationship between said radii of curvature $R_{ox}$ and $R_{oy}$ and the relationship between said radii of curvature $R_{iy}$ and $R_{ix}$ are respectively set such that $R_{ox}<R_{oy}$ and $R_{ix}>R_{iy}$, and under the condition that an equivalent radius of curvature along a diagonal line in the screen region on the outer surface of said panel is set as Rod (mm), an effective diameter of the screen along the diagonal line is set as V (inch) and the relationship between said equivalent radius of curvature Rod and said effective diameter V is set such that $Rod \geqq 10(42.5V+45)$.

2. A color cathode ray tube according to claim 1, wherein a ratio $R_{iy}/R_{ix}$ between the equivalent radius of curvature $R_{iy}$ along the Y axis in the screen region on the inner surface of said panel and the equivalent radius of curvature $R_{ix}$ along the X axis in the screen region on the inner surface of said panel is set to fall within the range of $0.7<(R_{iy}/R_{ix})<1.0$.

3. A color cathode ray tube according to claim 1, wherein on the condition that a peripheral portion which passes an end portion along the Y axis in the main scanning direction of said screen is set as a first peripheral portion and a peripheral portion which passes an end portion along the X axis in the direction perpendicular to said main scanning direction is set as a second peripheral portion, and an equivalent radius of curvature along the first peripheral portion in the screen region on the outer surface of said panel is set as $R_{ol}$ and an equivalent radius of curvature along the second peripheral portion in the screen region on the outer surface of said panel is set as $R_{os}$, the relationship between said equivalent radii of curvature $R_{ol}$, $R_{os}$ and said equivalent radius of curvature $R_{ox}$ along the X axis in the screen region on the outer surface of said panel and said equivalent radius of curvature $R_{oy}$ along the Y axis in the screen region on the outer surface of said panel is set such that $R_{ox} \geqq R_{ol}$ and $R_{oy} \geqq R_{os}$.

4. A color cathode ray tube according to claim 3, wherein a ratio $R_{ol}/R_{ox}$ between the equivalent radius of curvature $R_{ol}$ along the first peripheral portion in the screen region on the outer surface of said panel and the equivalent radius of curvature $R_{ox}$ along the X axis in the screen region on the outer surface of said panel is set to fall within the range of $0.8 \leqq (R_{ol}/R_{ox}) \leqq 1.0$, and a ratio $R_{os}/R_{oy}$ between the equivalent radius curvature $R_{os}$ along the second peripheral portion in the screen region on the outer surface of said panel and the equivalent radius of curvature $R_{oy}$ along the Y axis in the screen region on the outer surface of said panel is set to fall within the range of $0.8 \leqq (R_{os}/R_{oy}) \leqq 1.0$.

5. A color cathode ray tube according to claim 1, wherein on the condition that a peripheral portion which passes an end portion along the Y axis in the main scanning direction of said screen is set as a first peripheral portion and a peripheral portion which passes an end portion along the X axis in the direction perpendicular to said main scanning direction is set as a second peripheral portion, and an equivalent radius of curvature along the first peripheral portion in the screen region on the inner surface of said panel is set as $R_{il}$ and an equivalent radius of curvature along the second peripheral portion in the screen region on the inner surface of said panel is set as $R_{is}$, the relationship between said radii of curvature $R_{il}$, $R_{is}$ and said equivalent radius of curvature $R_{ix}$ along the X axis in the screen region on the inner surface of said panel and said equivalent radius of curvature $R_{iy}$ along the Y axis in the screen region on the inner surface of said panel is set such that $R_{ix} \geqq R_{il}$ and $R_{iy} \geqq R_{is}$.

6. A color cathode ray tube according to claim 5, wherein a ratio $R_{il}/R_{ix}$ between the equivalent radius of curvature $R_{il}$ along the first peripheral portion in the screen region on the inner surface of said panel and the equivalent radius of curvature $R_{ix}$ along the X axis in the screen region on the inner surface of said panel is set to fall within the range of $0.8 \leqq (R_{il}/R_{ix}) \leqq 1.0$, and a ratio $R_{is}/R_{iy}$ between the equivalent radius of curvature $R_{is}$ along the second peripheral portion in the screen region on the inner surface of said panel and the equivalent radius of curvature $R_{iy}$ along the Y axis in the screen region on the inner surface of said panel is set to fall within the range of $0.8 \leqq (R_{is}/R_{iy}) \leqq 1.0$.

7. A color cathode ray tube according to claim 1, wherein a peripheral portion which passes an end portion along the Y axis in the main scanning direction of said screen is set as a first peripheral portion and a peripheral portion which passes an end portion along the X axis in the direction perpendicular to said main scanning direction is set as a second peripheral portion, and an equivalent radius of curvature $R_{os}$ along the second peripheral portion in the screen region on the outer surface of said panel is set to equal to or more than 10000 mm.

8. A color cathode ray tube including a vacuum envelope which is constituted by a panel provided with a phosphor layer on an inner surface thereof, a neck accommodating an electron gun and a funnel which connects said panel with said neck, wherein on the condition that an axis which passes a tube axis in a main scanning direction of a screen formed by said panel is set as an X axis, an axis which passes said tube axis in a direction perpendicular to said main scanning direction of the screen is set as a Y axis, a peripheral portion which passes an end portion along the Y axis in the main scanning direction of said screen is set as a first peripheral portion and a peripheral portion which passes an end portion along the X axis in the direction perpendicular to said main scanning direction is set as a second peripheral portion, and an equivalent radius of curvature along the X axis in the screen region on the inner surface of said panel is set as $R_{ix}$, an equivalent radius of curvature along the Y axis in the screen region on the inner surface of said panel is set as $R_{iy}$, an equivalent radius of curvature along the first peripheral portion in the screen region on an outer surface of said panel is set as $R_{ol}$, an equivalent radius of curvature along the second peripheral portion in the screen region on the outer surface of said panel is set as $R_{os}$, an equivalent radius of curvature along the first peripheral portion in the screen region on the inner surface of said panel is set as $R_{il}$, an equivalent radius of curvature along the second peripheral portion in the screen region on the inner surface of said panel is set as $R_{is}$, the relationship between said equivalent radii of curvature $R_{ix}$ and $R_{iy}$, the relationship between said equivalent radii of curvature $R_{ol}$ and $R_{os}$ and the the relationship between said equivalent radii of curvature $R_{il}$ and $R_{is}$ are respectively set such that $R_{ix} > R_{iy}$, $R_{ol} < R_{os}$, and $R_{il} > R_{is}$.

9. A color cathode ray tube according to claim 8, wherein a ratio $R_{is}/R_{il}$ between the equivalent radius of curvature $R_{il}$ along the first peripheral portion in the screen region on the inner surface of said panel and the equivalent radius of curvature $R_{is}$ along the second peripheral portion in the screen region on the inner surface of said panel is set to fall within the range of $0.7 < (R_{is}/R_{il}) < 1.0$.

10. A color cathode ray tube according to claim 8, wherein on the condition that an equivalent radius of curvature along the X axis in the screen region on the outer surface of said panel is set as $R_{ox}$ and an equivalent radius of curvature along the Y axis in the screen region on the outer surface of said panel is set as $R_{oy}$, the relationship between said equivalent radii of curvature $R_{ox}$, $R_{oy}$ and said equivalent radius of curvature $R_{ol}$ along the first peripheral portion in the screen region on the outer surface of said panel and said equivalent radius of curvature $R_{os}$ along the second peripheral portion in the screen region on the outer surface of said panel is set such that $R_{ox} \geqq R_{ol}$ and $R_{oy} \geqq R_{os}$.

11. A color cathode ray tube according to claim 10, wherein a ratio $R_{ol}/R_{ox}$ between the equivalent radius of curvature $R_{ox}$ along the X axis in the screen region on the outer surface of said panel and the equivalent radius of curvature $R_{ol}$ along the first peripheral portion in the screen region on the outer surface of said panel is set to fall within the range of $0.8 \leqq (R_{ol}/R_{ox}) \leqq 1.0$, and a ratio $R_{os}/R_{oy}$ between the equivalent radius of curvature $R_{oy}$ along the Y axis in the screen region on the outer surface of said panel and the equivalent radius of curvature $R_{os}$ along the second peripheral portion in the screen region on the outer surface of said panel is set to fall within the range of $0.8 \leqq (R_{os}/R_{oy}) \leqq 1.0$.

12. A color cathode ray tube according to claim 8, wherein the relationship among said equivalent radius of curvature $R_{ix}$ along the X axis in the screen region on the inner surface of said panel, said equivalent radius of curvature $R_{iy}$ along the Y axis in the screen region on the inner surface of said panel, said equivalent radius of curvature $R_{il}$ along the first peripheral portion in the screen region on the inner surface of said panel, and said equivalent radius of curvature $R_{is}$ along the second peripheral portion in the screen region on the inner surface of said panel are set such that $R_{ix} \geqq R_{il}$ and $R_{iy} \geqq R_{is}$.

13. A color cathode ray tube according to claim 12, wherein a ratio $R_{il}/R_{ix}$ between the equivalent radius of curvature $R_{ix}$ along the X axis in the screen region on the inner surface of said panel and the equivalent radius of curvature $R_{il}$ along the first peripheral portion in the screen region on the inner surface of said panel is set to fall within the range of $0.8 \leqq (R_{il}/R_{ix}) \leqq 1.0$, and a ratio $R_{is}/R_{iy}$ between the equivalent radius of curvature $R_{iy}$ along the Y axis in the screen region on the inner surface of said panel and the equivalent radius of curvature $R_{is}$ along the second peripheral portion in the screen region on the inner surface of said panel is set to fall within the range of $0.8 \leqq (R_{is}/R_{iy}) \leqq 1.0$.

14. A color cathode ray tube according to claim 8, wherein the equivalent radius of curvature $R_{os}$ along the second peripheral portion in the screen region on the outer surface of said panel is set to equal to or more than 10000 mm.

15. A color cathode ray tube including a vacuum envelope which is constituted by a panel provided with a phosphor layer on an inner surface thereof, a neck accommodating an electron gun and a funnel which connects said panel with said neck and disposing a shadow mask having a large number of electron beam passing apertures in the vicinity of said phosphor layer, wherein on the condition that an axis which passes a tube axis in a main scanning direction of a screen formed by said panel is set as an X axis, an axis which passes said tube axis in a direction perpendicular to said main scanning direction of the screen is set as a Y axis, a peripheral portion which passes an end portion along the Y axis in the main scanning direction of said screen is set as a first peripheral portion and a peripheral portion which passes an end portion along the X axis in the direction perpendicular to said main scanning direction is set as a second peripheral portion, an equivalent radius of curvature $R_{os}$ along the second peripheral portion in the screen region on an outer surface of said panel is set to equal to or more than 10000 mm, and an equivalent radius of curvature along the X axis in the screen region on the inner surface of said panel is set as $R_{ix}$ and an equivalent radius of curvature along the Y axis in the screen region on the inner surface of said panel is set as $R_{iy}$, the relationship between said radii of curvature $R_{ix}$ and $R_{iy}$ is set such that $R_{ix}>R_{iy}$, and on the condition that an arrangement pitch of the electron beam passing apertures in the main scanning direction at a central portion of said shadow mask is set as $P_{ho}$ and an arrangement pitch of the electron beam passing apertures in the main scanning direction at an end portion along the X axis of said shadow mask is set as $P_{hx}$, the relationship between said arrangement pitches is set such that $P_{ho}<P_{hx}$, and on the condition that an equivalent radius of curvature along the Y axis in the apertures region on said shadow mask is set as $R_{my}$ and an equivalent radius of curvature along the X axis in the apertures region on said shadow mask is set as $R_{mx}$, the relationship between said radii of curvature $R_{mx}$ and $R_{my}$ is set such that $R_{mx}<R_{my}$.

16. A color cathode ray tube according to claim 15, wherein a ratio $R_{iy}/R_{ix}$ between the equivalent radius of curvature $R_{iy}$ along the Y axis in the screen region on the inner surface of said panel and the equivalent radius of curvature $R_{ix}$ along the X axis in the screen region on the inner surface of said panel is set to fall within the range of $0.7<(R_{iy}/R_{ix})<1.0$.

17. A color cathode ray tube according to claim 15, wherein a ratio $P_{hx}/P_{ho}$ between the arrangement pitch $P_{ho}$ of the electron beam passing apertures in the main scanning direction at the central portion of said shadow mask and the arrangement pitch $P_{hx}$ of the electron beam passing apertures in the main scanning direction at the end portion along the X axis of said shadow mask is set to fall within the range of $1.05<(P_{hx}/P_{ho})<1.4$.

18. A color cathode ray tube according to claim 15, wherein on the condition that an arrangement pitch of the electron beam passing apertures in the main scanning direction at an end portion along the Y axis of said shadow mask is set as $P_{hy}$ and an arrangement pitch of the electron beam passing apertures in the main scanning direction at a corner portion of said shadow mask is set as $P_{hd}$, the relationship between said arrangement pitches is set such that $P_{hy}<P_{hd}$.

19. A color cathode ray tube according to claim 18, wherein on the condition that an equivalent radius of curvature along the first peripheral portion in the apertures region on said shadow mask is set as $R_{ml}$ and an equivalent radius of curvature along the second peripheral portion in the apertures region on said shadow mask is set as $R_{ms}$, the relationship between said equivalent radii of curvature $R_{ml}$ and $R_{ms}$ is set such that $R_{ml}<R_{ms}$.

20. A color cathode ray tube according to claim 19, wherein a ratio $P_{hd}/P_{hy}$ between the arrangement pitch $P_{hy}$ of the electron beam passing apertures in the main scanning direction at an end portion along the Y axis of said shadow mask and the arrangement pitch $P_{hd}$ of the electron beam passing apertures in the main scanning direction at a corner portion of said shadow mask is set to fall within the range of $1.05<(P_{hd}/P_{hy})<1.4$.

* * * * *